US009045256B2

(12) United States Patent
Baker

(10) Patent No.: US 9,045,256 B2
(45) Date of Patent: Jun. 2, 2015

(54) PACKAGING CASE FOR A WINDSHIELD WIPER BLADE

(71) Applicant: Jay Baker, Mayville, NY (US)

(72) Inventor: Jay Baker, Mayville, NY (US)

( * ) Notice: Subject to any disclaimer, the term of this patent is extended or adjusted under 35 U.S.C. 154(b) by 53 days.

(21) Appl. No.: 13/844,669

(22) Filed: Mar. 15, 2013

(65) Prior Publication Data

US 2014/0262878 A1 Sep. 18, 2014

(51) Int. Cl.
*B65D 25/10* (2006.01)
*B65D 1/34* (2006.01)
*B65D 43/16* (2006.01)

(52) U.S. Cl.
CPC *B65D 25/10* (2013.01); *B65D 1/34* (2013.01); *B65D 43/162* (2013.01); *B65D 2543/00194* (2013.01); *B65D 2543/00296* (2013.01); *B65D 2543/00537* (2013.01); *B65D 2543/00666* (2013.01); *B65D 2543/00703* (2013.01); *B65D 2543/00731* (2013.01); *B65D 2543/00814* (2013.01); *B65D 2585/6885* (2013.01)

(58) Field of Classification Search
CPC ..... B65D 25/10; B65D 25/107; B65D 1/34; B65D 43/162; B65D 2585/6885; B65D 2543/00194; B65D 2543/00296
USPC ..... 206/471, 349, 470, 461, 521.1, 1.5; 220/835
See application file for complete search history.

(56) References Cited

U.S. PATENT DOCUMENTS

| | | | | |
|---|---|---|---|---|
| 5,899,334 | A * | 5/1999 | Domerchie et al. | 206/470 |
| 6,279,746 | B1 * | 8/2001 | Hussaini et al. | 206/470 |
| 7,527,151 | B2 | 5/2009 | Park | |
| 7,699,169 | B2 | 4/2010 | Lewis | |
| 7,926,659 | B2 | 4/2011 | Kim | |
| 7,975,849 | B2 | 7/2011 | Kim | |
| 8,042,690 | B2 * | 10/2011 | Lewis | 206/471 |
| 8,505,724 | B2 * | 8/2013 | Bult et al. | 206/448 |
| 8,613,357 | B2 * | 12/2013 | Putnam | 206/335 |
| 8,800,769 | B2 * | 8/2014 | Ehde | 206/471 |
| 2006/0081493 | A1 * | 4/2006 | Park | 206/470 |
| 2007/0235362 | A1 * | 10/2007 | Lewis | 206/470 |
| 2007/0272577 | A1 | 11/2007 | Kim | |
| 2008/0245691 | A1 * | 10/2008 | Kim | 206/335 |
| 2010/0307940 | A1 | 12/2010 | Kim | |
| 2012/0103852 | A1 * | 5/2012 | Putnam | 206/471 |
| 2012/0111858 | A1 * | 5/2012 | Lewis | 220/4.23 |
| 2012/0199598 | A1 * | 8/2012 | Lewis | 220/780 |
| 2013/0105343 | A1 * | 5/2013 | Bult et al. | 206/349 |
| 2014/0131238 | A1 * | 5/2014 | Ehde | 206/349 |

* cited by examiner

*Primary Examiner* — Steven A. Reynolds

(74) *Attorney, Agent, or Firm* — The Bilicki Law Firm, PC

(57) ABSTRACT

A packaging case for a windshield wiper blade includes an elongated wiper blade receiving section including a perimeter wall defining a blade-retaining channel. The perimeter wall includes inner and outer wall segments. At least one aperture is formed within the outer wall segment of the perimeter wall. An elongated cover section is pivotally coupled to wiper blade receiving section and configured to pivot between an open state and a closed state. The elongated cover section includes first and second lateral walls and first and second end walls defining a cover compartment that fits over the elongated wiper blade receiving section. At least one projection is formed on an inner surface of the first lateral wall for engaging the at least one aperture formed within the outer wall segment of the contoured wall, thereby retaining the cover section over the wiper blade receiving section.

12 Claims, 5 Drawing Sheets

PACKAGING CASE FOR A WINDSHIELD WIPER BLADE

FIELD OF THE INVENTION

The present invention relates to a packaging case for a windshield wiper blade used to wipe rain or dirt from a windscreen of automobiles, and more particularly to a packaging case that is easily secured in a closed position.

BRIEF SUMMARY OF THE INVENTION

A packaging case for a windshield wiper blade includes an elongated wiper blade receiving section including a contoured perimeter wall defining a blade-retaining channel. The perimeter wall has inner and outer wall segments. Retaining elements are formed within the inner wall segment of the perimeter wall for holding the wiper blade within the blade-retaining channel. At least one aperture is formed within the outer wall segment of the perimeter wall.

An elongated cover section is pivotally coupled to wiper blade receiving section and configured to pivot between an open state and a closed state. The elongated cover section includes first and second lateral walls and first and second end walls defining a cover compartment that fits over the elongated wiper blade receiving section. At least one projection is formed on an inner surface of the first lateral wall for engaging the at least one aperture formed within the outer wall segment of the perimeter wall, thereby retaining the cover section over the wiper blade receiving section.

DETAILED DESCRIPTION

In general, a wiper blade (not shown) includes a wiper strip to make close contact with a windshield, a frame configured to mount the wiper strip thereon, and a connector coupled to the frame so as to be coupled to a wiper arm of the automobile. Such a wiper blade is provided as a replaceable component and is commonly available from automobile specialty shops, large distribution and discount stores, etc. Typically, a wiper blade can be sold in a separate packaging case for identification and protection of the products. The packaging case prevents damage of the wiper blade accommodated therein and enables the wiper blades to be maintained in an optimal state. The wiper blade may be a 24" wiper blade by Trico.

Figure 1:
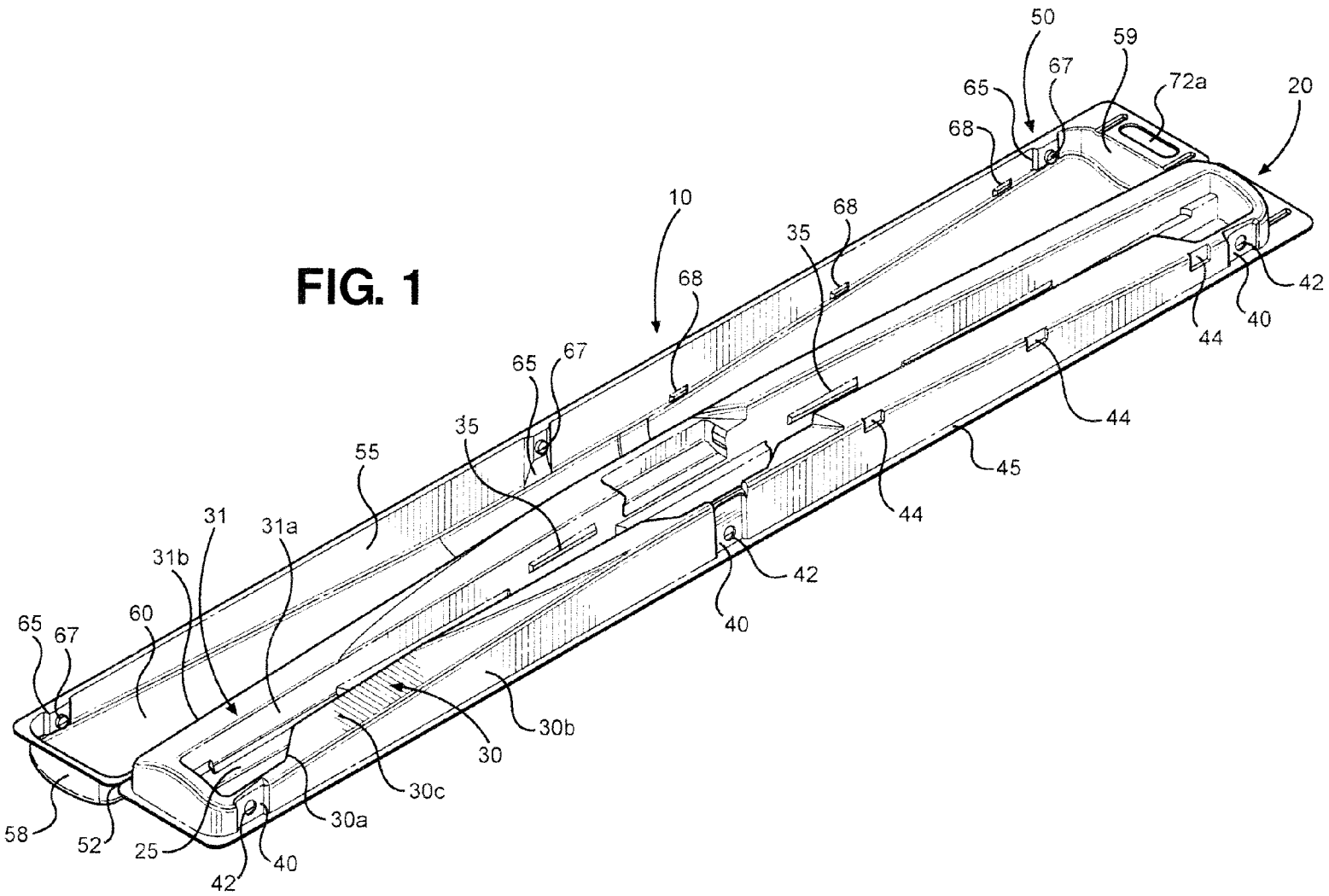
FIG. 1 is a perspective view of a packaging case of a windshield wiper blade according to an embodiment of the present invention, in which the packaging case is opened to accommodate a wiper blade.
Figure 2:
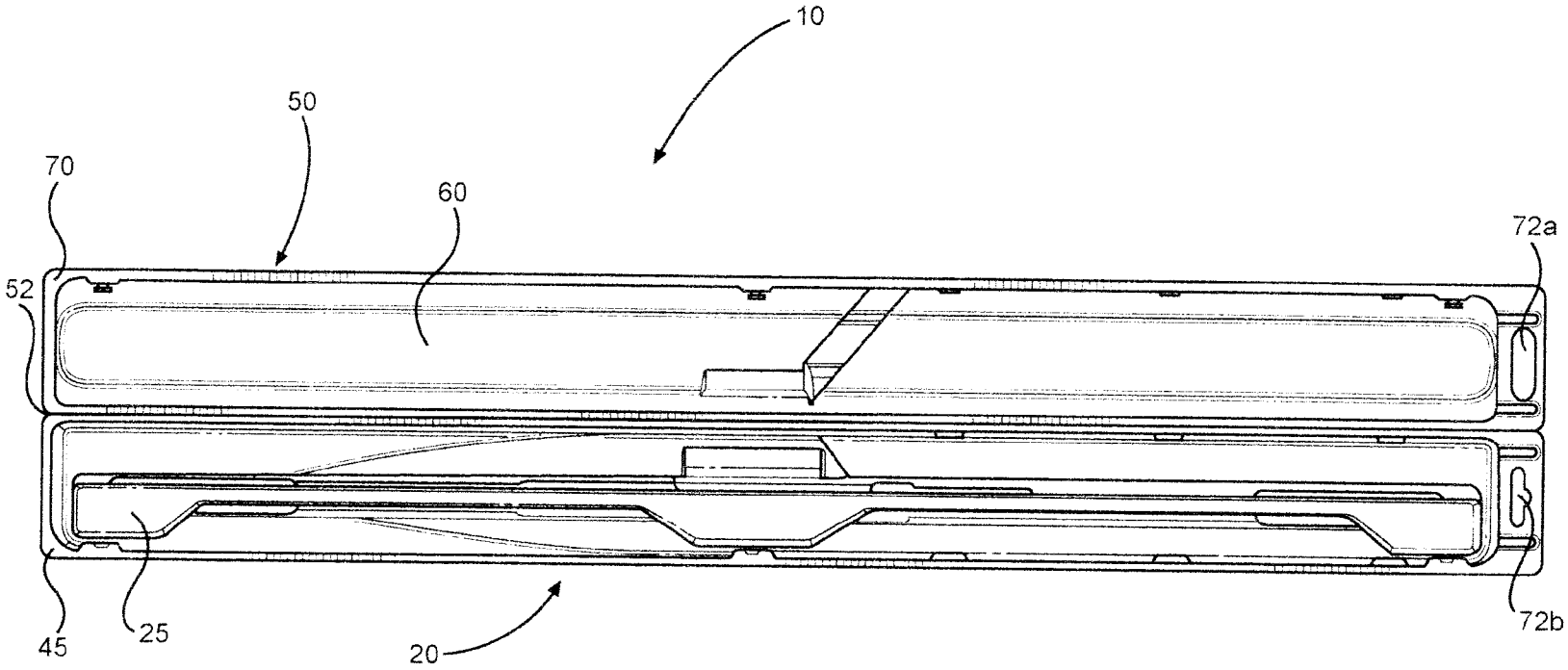
FIG. 2 is a top view of the packaging case of the wiper blade according to an embodiment of the present invention.
Figure 3:
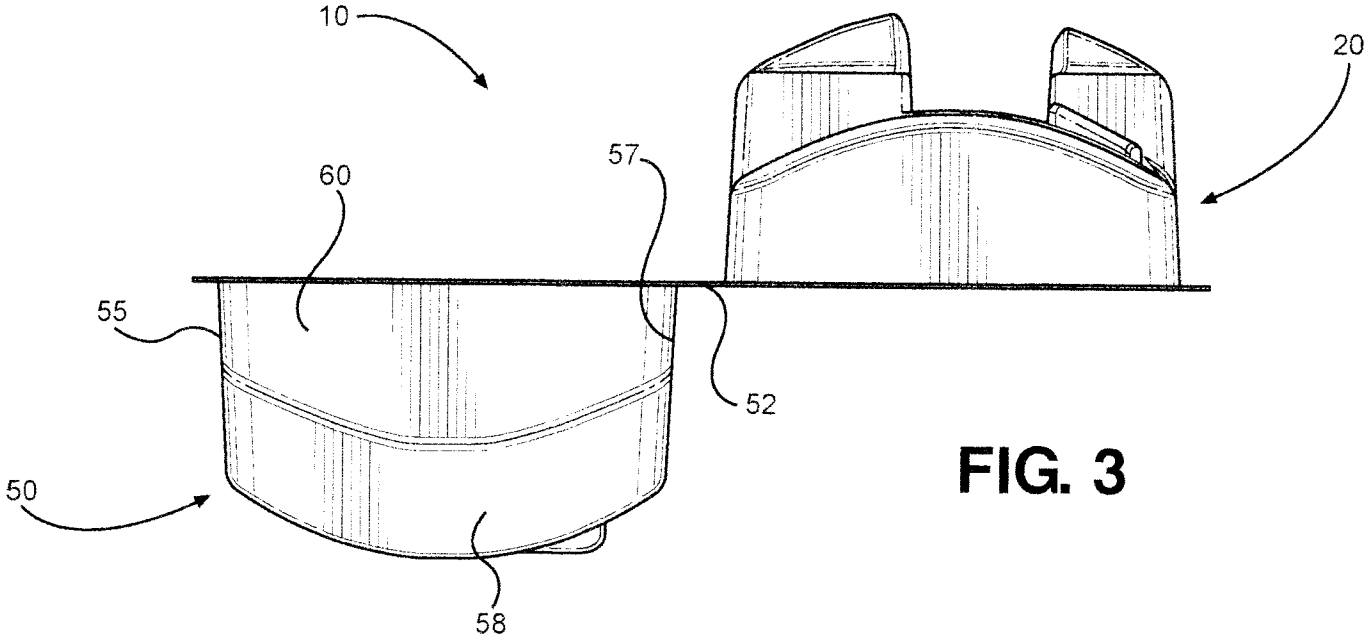
FIG. 3. is an end view of the packaging case of a windshield wiper blade, in which the packaging case is opened to accommodate the wiper blade.
Figure 4:
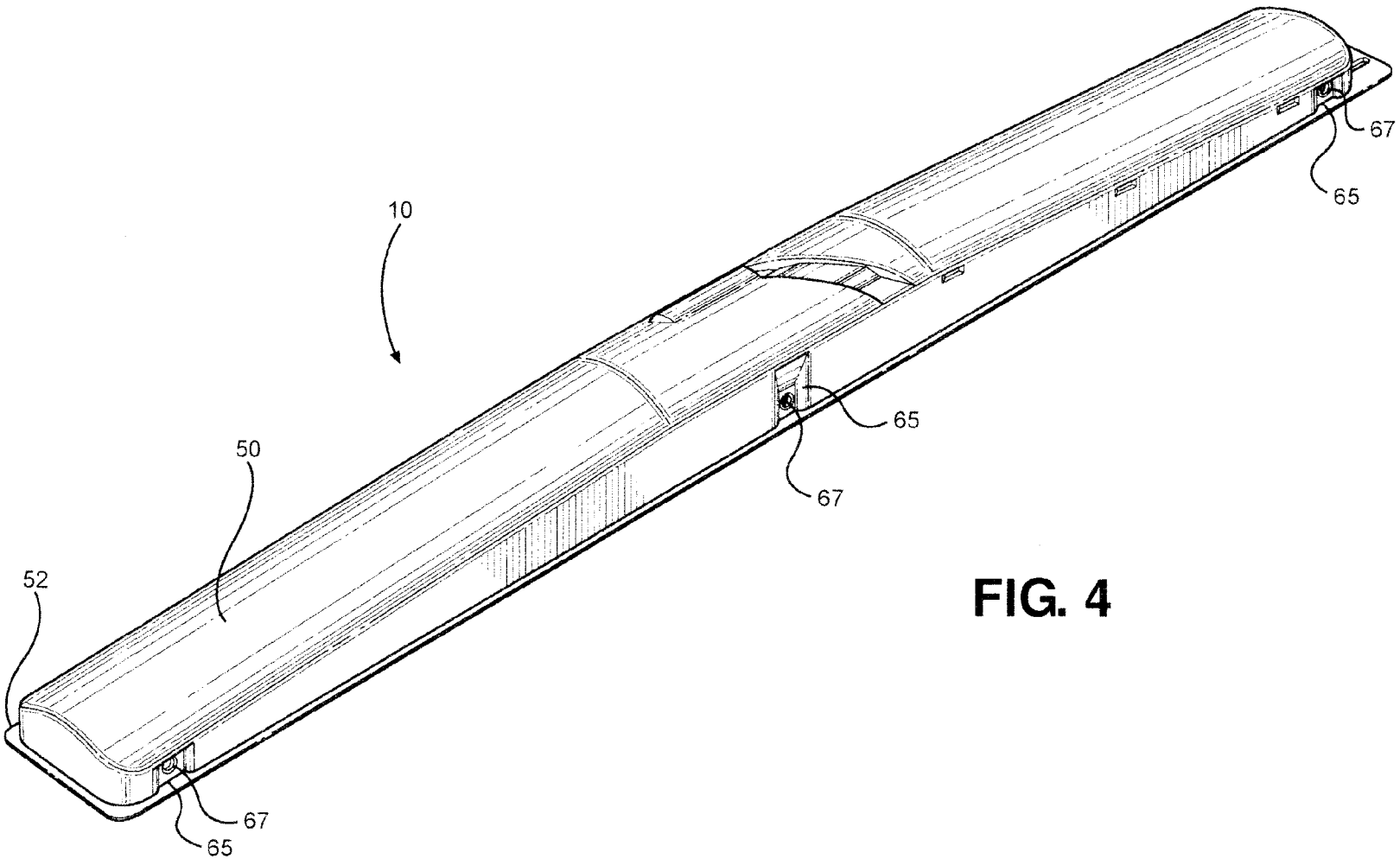
FIG. 4 is a perspective view of the packaging case of a windshield wiper blade, in which the packaging case is closed.
Figure 5:
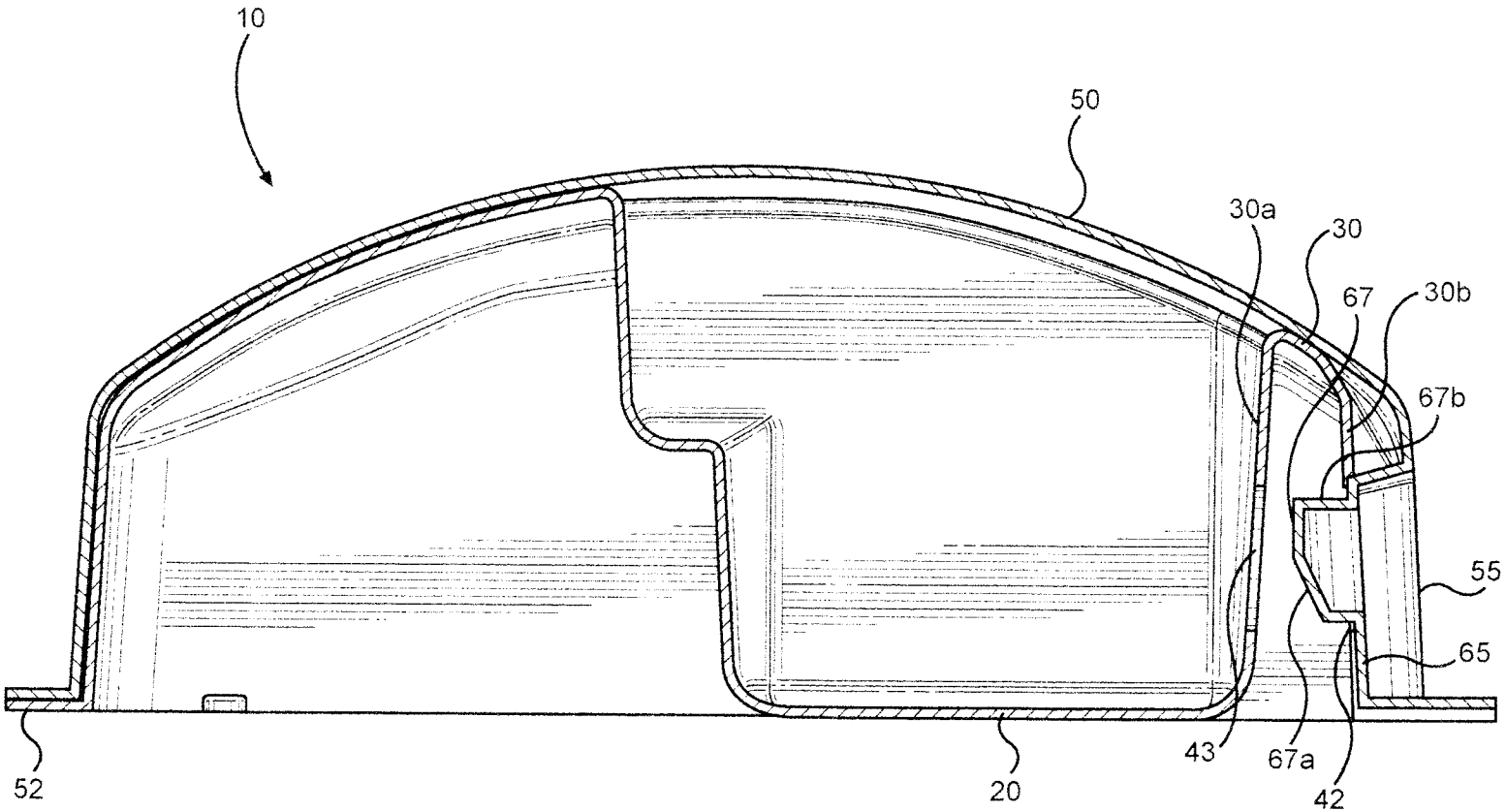
FIG. 5 is a cross-sectional view illustrating the packaging case of the wiper blade in a closed state to accommodate a wiper blade.

In accordance with the present embodiments of a packaging case for a windshield wiper, FIG. 1 illustrates a perspective view of a packaging case 10 for a windshield wiper blade, in which packaging case 10 is opened to accommodate the wiper blade. FIG. 2 is a top view of packaging case 10 in an open position. FIG. 3 is an end view of packaging case 10 of a windshield wiper blade, in which packaging case 10 is opened to accommodate the wiper blade. FIGS. 4 and 5 are perspective and cross-sectional views of packaging case 10 in a closed position.

Packaging case 10 includes an elongated wiper blade receiving section 20 having a blade retaining-channel or accommodating pocket 25 defined by a perimeter wall having a first elongated wall 30 having a spaced-apart inner wall segment 30*a* and an outer wall segment 30*b* adjoined by a top ledge 30*c*. Perimeter wall also includes a second elongated wall 31 having spaced-apart inner wall segment 31*a* and an outer wall segment 31*b* adjoined by a top ledge 31*c*. A plurality of retaining elements, one of which is indicated at 35, is formed within inner wall segments 30*a* and 31*a* for holding a wiper blade securely within blade accommodating pocket 25.

Each retaining element 35 is formed to have a predetermined elasticity, so that, when a wiper blade is positioned within blade accommodating pocket 25, the wiper blade is securely held in position by retaining elements 35. Retaining elements 35 may take on a variety of forms. For example, retaining elements 35 may be symmetrically or asymmetrically shaped. Furthermore, retaining elements 35 may be disposed in a staggered pattern on inner wall segments 30*a* and 31*a*, so that the wiper blade can be more easily inserted or taken out of blade accommodating pocket 25. In the embodiment shown, blade-accommodating pocket 25 is contoured to accommodate the shape of a wiper blade in order to more securely retain the wiper blade.

In order to facilitate a secure closure of packaging case 10, outer wall segment 30*b* of first elongated wall 30 includes a plurality of depressions, generally indicated at 40. An aperture 42 is formed within each depression 40 for engaging a projection formed on an elongated cover section, as will be discussed in detail below. An additional plurality of apertures 43 (see FIG. 5), which align with apertures 42, may also be formed within inner wall segment 30*a* of first elongated wall 30. First elongated wall 30 also includes notches 44 formed therein. A flange 45 extends from a perimeter of blade receiving section 20.

Packaging case 10 also includes an elongated cover section 50 pivotally coupled to wiper blade receiving section at a hinge 52. Elongated cover section 50 is configured to pivot about hinge 52 between an open state and a closed state. In particular, cover section 50 includes first and second lateral walls 55, 57 and first and second end walls 58, 59 defining a cover compartment 60 that fits over elongated wiper blade receiving section 20. First lateral wall 55 includes a plurality of inwardly protruding sections 65 shaped to correspond with depressions 40 formed within outer wall segment 30*b* of first elongated wall 30. In addition, a post 67 projects from each inwardly protruding section 65. Each post 67 is adapted to engage a corresponding aperture 42. Tabs 68 are also formed within and project inward from first lateral wall 55. Tabs 68 are positioned such that they engage notches 44 with packaging case 10 in a closed position. A flange 70 extends horizontally from a perimeter elongated cover section 50 such that when packaging case 10 is in a closed position flange 70 abuts flange 45 of blade receiving section 20.

Each of flanges 45 and 70 includes a hanger opening 72*a*, 72*b* formed at one side such that the packaging case 10 can be hung on and kept in a display rack used for storage or selling of wiper blades encased in packaging case 10. When packaging case 10 is in a closed position hanger openings 72*a* and 72*b* align with one another. Hanger openings 72*a* and 72*b* are formed by a circular hole, a linear groove, or a combination such that packaging case 10 can be hung on any display rack having a circular rack rod or a thin plate-shaped rack rod. Thus, packaging case 10 can be suspended from a display rack through hanger openings 72*a* and 72*b*.

FIG. 4 is a perspective view of the packaging case of a windshield wiper blade, in which the packaging case is closed and FIG. 5 is a cross-sectional view of the packaging case in a closed position. In the embodiment illustrated, elongated wiper blade receiving section 20 and elongated cover section 50 are an integral component and are pivotally connected to each other via hinge 52.

Hereinafter, a process of manufacturing the packaging case according to an embodiment of the present invention is described. Packaging case 10 may be formed completely or partially of a transparent material to allow a user to see the interior of the packaging case. In particular, packaging case 10 is manufactured using a thermoforming process. In order produce a projection, such as post 67, or other shaped projection in a vertical or nearly vertical sidewall of a thermoformed package, retractable tooling features are incorporated into a tool, which forms the package. These features can be of a variety of shapes and sizes.

Packaging case 10 is formed from a preheated sheet of thermoplastic material that is drawn into, or over a mold to create the desired shape of the end product. After the material has reached a stable set point, where upon it is rigid enough to be removed from the mold without loosing the shape of the mold upon which it was formed, the sheet is withdrawn in the opposite direction from which it entered the mold. Typically the sheet enters the mold and is removed from the mold in a vertical fashion. Posts 67 are formed utilizing retractable features, such as a round post, or pin. When the heated plastic sheet is drawn into the mold the post is in an extended position. The plastic forms around the post, adopting its shape. The post is then retracted until the face of the post is flush with the sidewall of the mold. Thus, the post is out of the way such that the plastic product can be removed from the mold. The actual mechanization of the post, or feature can be accomplished in a number of ways. Mechanical linkages and drive mechanisms may be used. Alternately, magnetics, pneumatic cylinders or the like may be employed. The timing of the projection of the feature outbound from the sidewall of the mold may be fine tuned by being in the fully extended position prior to the heated material entering the mold and being activated just after the material has entered the mold, but prior to the material cooling beyond the point where it will be able to form around the feature.

Apertures 42 are formed within outer wall segment 30*b* of wall 30, which is a vertical or nearly vertical surface. A punch and die mechanism is utilized to form apertures 42 and 43. The punch and die may mimic the profile of the formed post 67, but with a slightly larger profile to allow for clearance and ease of insertion of the formed posts 67 within apertures 43 and 43. Alternatively, the cutout may take a shape that is different from the formed projection. For example, the formed projection could be a simple post, but the cutout could be oval in shape. The function of projections or posts 67 and cutouts or apertures 42, 43 is to prevent the vertical opening of cover section 50 of packaging case 10. Similarly, apertures 42, 43 may be round and projections may be star, octagonal, or the like, in shape. Apertures 42 and 43 are formed after the forming of packaging case 10. Thus, the plastic has formed into the mold, the plastic has been demolded and then the apertures are cutout. In high volume production the cutting of the hole feature occurs at a station between a forming station and a die cutting station. It is in the die cutting station that the planer surfaces of the plastic container are trimmed from the surrounding web of material so that the container can be removed from a leftover perimeter sheet.

Apertures 42 and 43 may also be formed following a die cutting step, i.e. after the formed and die cut plastic part has been removed from the surrounding left over plastic sheet. Thus, the last step in the process is to place the formed and die cut package into a mechanical device, which then punches out the holes. The holes may be formed by a manually actuated device punching one hole at a time or by a fully automated system punching all the holes in a package at once, with automated load and unload of the package into the punching mechanism. The holes may also be cut in the same station as where the planer die cut of the perimeter plastic occurs.

In use, a wiper blade is positioned within blade accommodating pocket 25 of elongated wiper blade-receiving section 20. Retaining elements 35 are adapted to hold a wiper blade in position within blade accommodating pocket 25. Cover section 50 is then rotated to cover wiper blade receiving section 20. At this time, posts 67 and inwardly protruding sections 65 engage depressions 40 and corresponding apertures 42. In particular, posts 67 of cover section 50 penetrate apertures 42 of blade receiving section 20, thereby securing cover section 20 to blade receiving section 20. As shown in FIG. 5, post 67 includes an angled edge 67*a* and a top edge 67*b*. Each post 67 penetrates a corresponding aperture 42 to prevent cover 50 from being pivoted open. In order to open packaging case 10, post 67 and first lateral wall 55 must be deflected laterally such that post 67 disengages from a corresponding aperture 42. A plurality of apertures 43 are also provided in inner wall segment 30*a* of first elongated wall 30 such that posts 67 may penetrate apertures 43 if first lateral wall 55 is pushed inward. Thus, inward deflection of lateral wall 55 will not cause posts 67 to become disengaged from apertures 42.

In general, the posts and apertures engage to form a locking feature that uses the shear strength of a post engaged against the wall of material through which the aperture is formed. The force required to separate the posts from the apertures is a function of the shear strength of the formed post, and or the tear strength of the punched hole, rather than the function of friction.

The downward force of closing elongated cover section 50 over blade receiving section 20 drives post 67 having beveled edge 67*a* down across the outer wall segment 30*b* descending the wall of the package until the post "snaps" into the hole. Since the posts and apertures are formed on vertical walls at 90 degrees, no additional material is required to form a secure closure of packaging case 10.

Although the present invention has been described with reference to the embodiments and the accompanying drawings, it is not limited to the embodiments and the drawings. It should be understood that various modifications and changes can be made by those skilled in the art without departing from the spirit and scope of the present invention defined by the accompanying claims.

What is claimed is:

1. A packaging case for a windshield wiper blade comprising:

an elongated wiper blade receiving section including a peripheral wall defining a blade-retaining channel, said peripheral wall including a first elongated wall and a second elongated wall, each having spaced apart inner and outer wall segments;

retaining elements formed within the inner wall segment of the peripheral wall for holding the wiper blade within the blade-retaining channel;

at least one aperture formed within the outer wall segment of the first elongated wall;

an elongated cover section pivotally coupled to wiper blade receiving section and configured to pivot between an open state and a closed state, said cover section including first and second lateral walls and first and second end walls defining a cover compartment that fits over the elongated wiper blade receiving section;

at least one projection formed in the first lateral wall of the cover section for engaging the at least one aperture formed within the outer wall segment of the first elongated wall, thereby retaining the cover section over the wiper blade receiving section;

at least one depression formed within the outer wall segment wherein said at least one aperture is formed within the at least one depression; and at least one inwardly protruding section formed in the first lateral wall shaped to correspond with said at least one depression formed within the outer wall segment, wherein said at least one projection is formed within the at least one inwardly protruding section.

2. The packaging case for a windshield wiper blade of claim 1 further comprising at least one additional aperture formed in the inner wall segment, said at least one additional aperture being aligned with the at least one aperture formed within the outer wall segment such that said at least one projection formed in the first lateral wall of the cover section is adapted to pass through said at least one additional aperture.

3. The packaging case for a windshield wiper blade of claim 1 further comprising at least one notch formed within the outer wall segment of the perimeter wall and at least one tab formed in the first lateral wall of the cover section for engaging the at least one notch formed within the outer wall segment of the perimeter wall.

4. The packaging case for a windshield wiper blade of claim 1 wherein the at least one projection formed in the first lateral wall of the cover section is a post having an angled edge.

5. A packaging case for a windshield wiper blade comprising:

an elongated wiper blade receiving section including a perimeter wall defining a blade-retaining channel, said perimeter wall including a first elongated wall and a second elongated wall, each having spaced apart inner and outer wall segments;

retaining elements formed within the inner wall segment of perimeter wall for holding the wiper blade within the blade-retaining channel;

at least one aperture formed within the outer wall segment of the perimeter wall;

an elongated cover section pivotally coupled to wiper blade receiving section and configured to pivot between an open state and a closed state, said cover section including first and second lateral walls and first and second end walls defining a cover compartment that fits over the elongated wiper blade receiving section;

at least one projection formed in the first lateral wall of the cover section for engaging the at least one aperture formed within the outer wall segment, thereby retaining the cover section over the wiper blade receiving section; and at least one additional aperture formed in the inner wall segment, said at least one additional aperture being aligned with the at least one aperture formed within the outer wall segment such that said at least one projection formed in the first lateral wall of the cover section is adapted to pass through said at least one additional aperture.

6. The packaging case for a windshield wiper blade according to claim 5 further comprising at least one depression formed within the outer wall segment wherein said at least one aperture is formed within the at least one depression.

7. The packaging case for a windshield wiper blade of claim 6 further comprising at least one inwardly protruding section formed in the first lateral wall shaped to correspond with said at least one depression formed within the outer wall segment, wherein said at least one projection is formed within the at least one inwardly protruding section.

8. The packaging case for a windshield wiper blade of claim 5 further comprising at least one notch formed within the outer wall segment of the perimeter wall and at least one tab formed in the first lateral wall of the cover section for engaging the at least one notch formed within the outer wall segment of the perimeter wall.

9. The packaging case for a windshield wiper blade of claim 5 wherein the at least one projection formed in the first lateral wall of the cover section is a post having an angled edge.

10. A packaging case for a windshield wiper blade comprising:

an elongated wiper blade receiving section including a perimeter wall defining a blade-retaining channel, said perimeter wall including a first elongated wall and a second elongated wall, each having spaced apart inner and outer wall segments;

retaining elements formed within the inner wall segment of perimeter wall for holding the wiper blade within the blade-retaining channel;

at least one aperture formed within the outer wall segment of the perimeter wall;

an elongated cover section pivotally coupled to wiper blade receiving section and configured to pivot between an open state and a closed state, said cover section including first and second lateral walls and first and second end walls defining a cover compartment that fits over the elongated wiper blade receiving section;

at least one projection formed in the first lateral wall of the cover section for engaging the at least one aperture formed within the outer wall segment, thereby retaining the cover section over the wiper blade receiving section;

at least one additional aperture formed in the inner wall segment, said at least one additional aperture being aligned with the at least one aperture formed within the outer wall segment such that said at least one projection formed in the first lateral wall of the cover section is adapted to pass through said at least one additional aperture;

at least one depression formed within the outer wall segment wherein said at least one aperture is formed within the at least one depression; and at least one inwardly protruding section formed in the first lateral wall shaped to correspond with said at least one depression formed within the outer wall segment, wherein said at least one projection is formed within the at least one inwardly protruding section.

11. The packaging case for a windshield wiper blade of claim 10 further comprising at least one notch formed within the outer wall segment of the perimeter wall and at least one tab formed in the first lateral wall of the cover section for engaging the at least one notch formed within the outer wall segment of the perimeter wall.

12. The packaging case for a windshield wiper blade of claim 10 wherein the at least one projection formed in the first lateral wall of the cover section is a post having an angled edge.

* * * * *